US012042847B2

(12) United States Patent
Guerche et al.

(10) Patent No.: US 12,042,847 B2
(45) Date of Patent: Jul. 23, 2024

(54) LOST WAX MOLDING MANUFACTURING PROCESS

(71) Applicant: SAFRAN AIRCRAFT ENGINES, Paris (FR)

(72) Inventors: Didier Maurice Marceau Guerche, Moissy-Cramayel (FR); Joseph Toussaint Tami Lizuzu, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 18/550,230

(22) PCT Filed: Mar. 8, 2022

(86) PCT No.: PCT/FR2022/050416
§ 371 (c)(1),
(2) Date: Sep. 12, 2023

(87) PCT Pub. No.: WO2022/195196
PCT Pub. Date: Sep. 22, 2022

(65) Prior Publication Data

US 2024/0157433 A1 May 16, 2024

(30) Foreign Application Priority Data

Mar. 16, 2021 (FR) ..... 2102604

(51) Int. Cl.
*B22C 7/02* (2006.01)
*B22C 9/04* (2006.01)
(Continued)

(52) U.S. Cl.
CPC ..... *B22C 7/02* (2013.01); *B22C 9/04* (2013.01); *B22C 9/103* (2013.01); *B22C 9/22* (2013.01); *B22C 21/14* (2013.01); *B22D 25/02* (2013.01)

(58) Field of Classification Search
CPC .... B22C 7/02; B22C 9/04; B22C 9/10; B22C 9/103; B22C 9/22; B22D 25/02
See application file for complete search history.

(56) References Cited

U.S. PATENT DOCUMENTS

2007/0025851 A1 2/2007 Guerche et al.
2022/0288671 A1 9/2022 Rollinger et al.

FOREIGN PATENT DOCUMENTS

EP 3036055 A1 6/2016
FR 2889088 A1 2/2007
(Continued)

OTHER PUBLICATIONS

International Search Report mailed Jun. 7, 2022, issued in corresponding International Application No. PCT/FR2022/050416, filed Mar. 8, 2022, 2 pages.
(Continued)

*Primary Examiner* — Kevin P Kerns
*Assistant Examiner* — Steven S Ha
(74) *Attorney, Agent, or Firm* — Christensen O'Connor Johnson Kindness PLLC

(57) ABSTRACT

A method for making a wax model for the manufacture of a part, the part including at least one cavity, the method including: arranging at least two core elements made of a ceramic material into a wax mold, the core elements having at least partially a shape complementary to the cavity of the part to be manufactured, and injecting wax into the wax mold, around the core elements, so as to form the wax model, the two core elements being assembled prior to the
(Continued)

injection of wax by at least one staple, the staple including a central portion from which two branches extend, each branch being fitted into an orifice formed in one of the core elements.

9 Claims, 4 Drawing Sheets

(51) Int. Cl.

| | |
|---|---|
| ***B22C 9/10*** | (2006.01) |
| ***B22C 9/22*** | (2006.01) |
| ***B22C 21/14*** | (2006.01) |
| ***B22D 25/02*** | (2006.01) |

(56) References Cited

FOREIGN PATENT DOCUMENTS

| | | | |
|---|---|---|---|
| WO | 2021038174 | A1 | 3/2001 |
| WO | 2004033128 | A2 | 4/2004 |
| WO | 2015026535 | A1 | 2/2015 |

OTHER PUBLICATIONS

Written Opinion of the International Searching Authority mailed Jun. 7, 2022, issued in corresponding International Application No. PCT/FR2022/050416, filed Mar. 8, 2022, 6 pages.

LOST WAX MOLDING MANUFACTURING PROCESS

TECHNICAL FIELD

The present disclosure relates to the field of turbines, in particular turbines of turbine engines, and concerns a method for manufacturing parts, in particular vanes, by lost-wax casting, said parts comprising cavities intended for the circulation of cooling fluids.

BACKGROUND

Turbine vanes are subjected to high thermal stresses and comprise means for cooling by circulation of a heat-transfer fluid, in general air in the case of a gas turbine engine, inside cavities formed in the vane.

In general, turbine vanes are manufactured by casting, in particular by lost-wax casting. This technique consists in making a wax model of the part to be manufactured. The wax model is wrapped in a shell mold made of ceramic. The latter is manufactured by successive dipping of the wax model in slurries containing a ceramic material and by stuccoing the layer formed between each dipping. The wax model is eliminated during a first curing at a suitable temperature. Afterwards, the shell mold is cured at a high temperature to confer thereon the strength required for casting the metal.

The shell mold then includes a cavity forming a hollowed image of the model, molten metal being cast into the cavity. After cooling, the shell mold is broken to clear the part. Afterwards, it undergoes a finish treatment.

When the vane comprises cavities for the circulation of the cooling fluid, one or more core element(s) should be incorporated into the model. This phase of the manufacturing method firstly comprises the separate manufacturing operation of the core element(s) by molding a ceramic material consolidated by a binder, the assembly thereof where appropriate, and the placement of the core element(s) in a wax mold. Thus, a wax model is made by injecting wax into the wax mold. This wax model is a replica of the part to be obtained.

FIG. 1 shows, in a section perpendicular to the axis of the part, a wax mold 10 whose inner wall is the image of the part to be obtained. This wax mold is herein made of two portions 10A and 10B. A core 13 composed of a plurality of branches 13A to 13G parallel to one another is arranged in the mold 10. The branches define spaces therebetween which will form partitions after casting of the metal. To ensure wedging of the core inside the mold, pins 20 made of platinum are arranged between the core 13G and the wall 17 of the mold, the pins 20 serving as spacers. Afterwards, a shell mold made of ceramic is obtained after extraction of the wax model. Afterwards, molten metal is cast into the space between the walls of the ceramic mold and those of the core. The pins are then melted and dissolved in the metal. Afterwards, the ceramic core is removed by an appropriate treatment.

The function of the pins is to keep a space between the walls of the core and the inner wall of the mold, in particular during the injection of wax into the wax mold. This allows guaranteeing compliance with the dimensions of the wax model, and therefore of the shell mold made of ceramic and of the metal part to be manufactured.

However, in the case of a part to be manufactured comprising cavities with complex geometries, it is necessary to resort to numerous core elements. This increases the complexity of the method and makes it difficult to hold the core elements in position in the wax model. Increasing the number of pins also increases the risk of pins being left by the manufacturer, which would locally modify the geometry of the core. Furthermore, the cost of the manufactured part is higher, because of the complexity of the manufacturing method.

SUMMARY OF THE DISCLOSURE

The present disclosure aims to provide a method for manufacturing a part with cavities by wax casting while ensuring accurate thicknesses of the walls of the part, in a reliable and inexpensive manner.

To this end, the present disclosure provides a method for making a wax model for the manufacture of a part, such as a turbine vane, the part comprising at least one cavity, the method comprising the steps of: arranging at least two core elements made of a ceramic material in a wax mold, the core elements having at least partially a shape complementary to the cavity of the part to be manufactured, and injecting wax into the wax mold, around the core elements, so as to form the wax model, wherein the two core elements are assembled prior to the injection of wax by at least one staple, the staple including a central portion from which two branches extend, each branch being fitted into an orifice formed in one of the core elements.

Thus, the staple allows holding the core elements in position with respect to each other and/or with respect to the inner surface of the wax mold, in particular during the injection of wax into the wax mold. Thus, the wax model obtained forms a replica whose dimensions are controlled, so that the part manufactured on the basis of this model meets the dimensional specifications. One or two staples may hold two core elements in place with respect to each other, thereby allowing reducing the cost of the manufacturing method. Furthermore, once the staple is in position, for example after bonding, it will remain in position throughout the entire process without the risk of the part being lost or moved even slightly, thereby resulting in an improper positioning. Thus, the staple guarantees a proper wall thickness around the core.

The core elements may partially have a shape that is complementary to the cavity and their assembly may have entirely the shape that is complementary to the cavity.

The staple may have a U-, C-, V- or M-like general shape.

The part to be manufactured may comprise at least two cavities each formed by a core, whose shape may depend on the shape of the cavity to be made.

The method may comprise, prior to the assembly of the two core elements by the staple, a step consisting in positioning at least one spacer between the two core elements to hold the core elements at a predetermined distance from each other. The spacer can be removed after fastening the staple.

The two core elements may be directly assembled by the staple without using the spacer.

At least one, in particular each, of the branches of the staple may be held in the respective orifice by gluing.

Gluing of one of the branches of the staple may be achieved by applying glue, for example of the type Loctite®, or by applying wax or any other suitable means to hold the branch in the corresponding orifice.

At least one, in particular each, orifice of one of the core elements may be a blind orifice. This allows limiting the length of the branches of the staple.

At least one, in particular each, orifice of one of the core elements may be an open-through orifice, the corresponding branch of the staple passing through the orifice and the free end of the branch being folded over the corresponding core so as to block the staple in position. This ensures a more reliable holding of the relative position of the core elements.

The central portion and the two branches of the staple may have a circular cross section.

At least one, in particular each, orifice of one of the core elements may have a diameter that is comprised between 0.5 mm and 1 mm, in particular equal to 0.8 mm. The staple may have a diameter that is substantially identical to the diameter of the corresponding orifice(s), with a mounting clearance which is for example in the order of magnitude of 0.1 mm.

The staple may be made of platinum or may be made of another material, depending on the metal material intended for casting.

The cores may have first lateral surfaces facing the same side. The staple may be placed so that the central branch is against the first lateral faces of the cores.

The branches of the staple may extend in the same direction while passing through the cores.

The distal portions of the branches of the staple may be folded over second lateral surfaces of the cores opposite to the first lateral surfaces. In particular, the branches of the staple may be folded over the lateral surfaces along two opposite directions.

The present disclosure also relates to a method for manufacturing a part, such as a turbine vane, comprising at least one cavity including the steps of: making a wax model according to the aforementioned method; forming a shell mold made of a ceramic material from the wax model; eliminating the wax model; casting a molten metallic material into the shell mold.

The shell mold may be manufactured by successive dipping of the wax model in slurries containing a ceramic material and by stuccoing the layer formed between each dipping.

The wax model may be removed from the shell mold by curing at a suitable temperature.

The shell mold may be cured at a high temperature after removal of the wax model.

The shell mold may be eliminated after casting of the metallic material by a suitable mechanical and/or chemical treatment.

The part may be a moving vane or a turbine stator vane.

DETAILED DESCRIPTION

Figure 1:
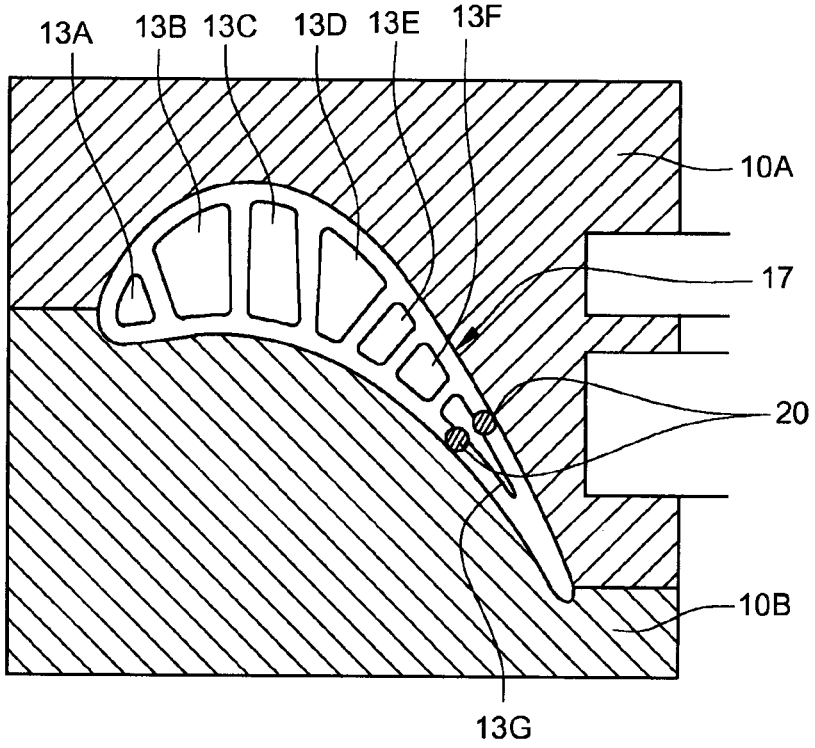
FIG. 1, described above, shows a schematic view of a wax mold for making a wax model.
Figure 2:
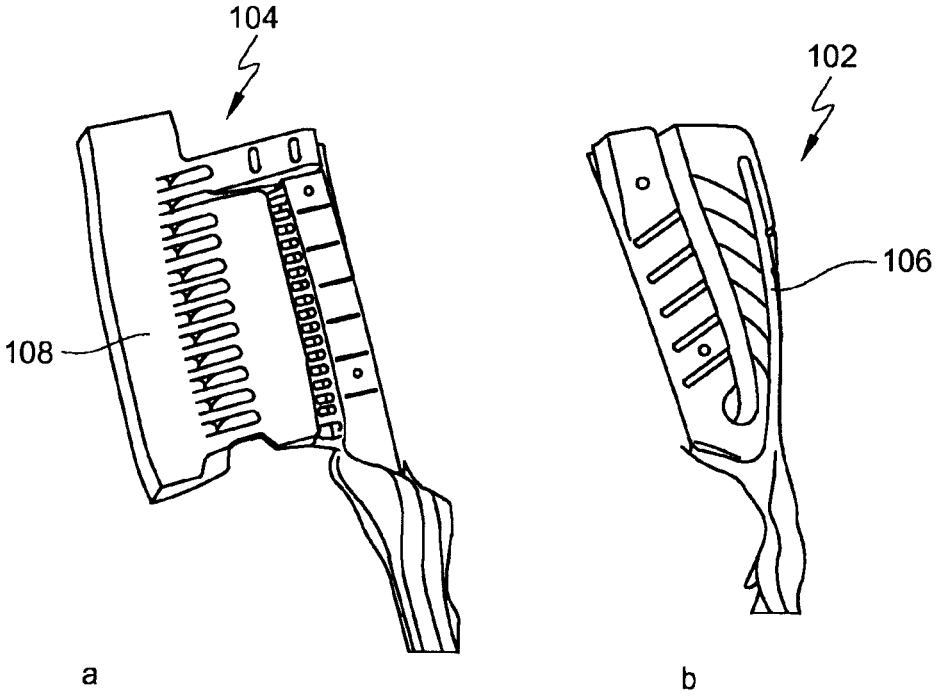
FIGS. 2*a* and 2*b* are schematic perspective views of two core elements each intended to form a corresponding cavity in a vane to be manufactured.

Referring to FIGS. 2*a*-6, a wax model for manufacturing a vane is obtained by injecting wax into the wax mold 10. Prior to the wax injection, core elements 102 and 104 are arranged in the wax mold 10 in lieu of the core elements 13. The core elements 102 and 104 are made of a ceramic material. An outer face 106 of the core 102 defines the leading edge of the vane to be made. A portion 108 of the core 104 defines the trailing edge of the vane to be made.

Figure 3:
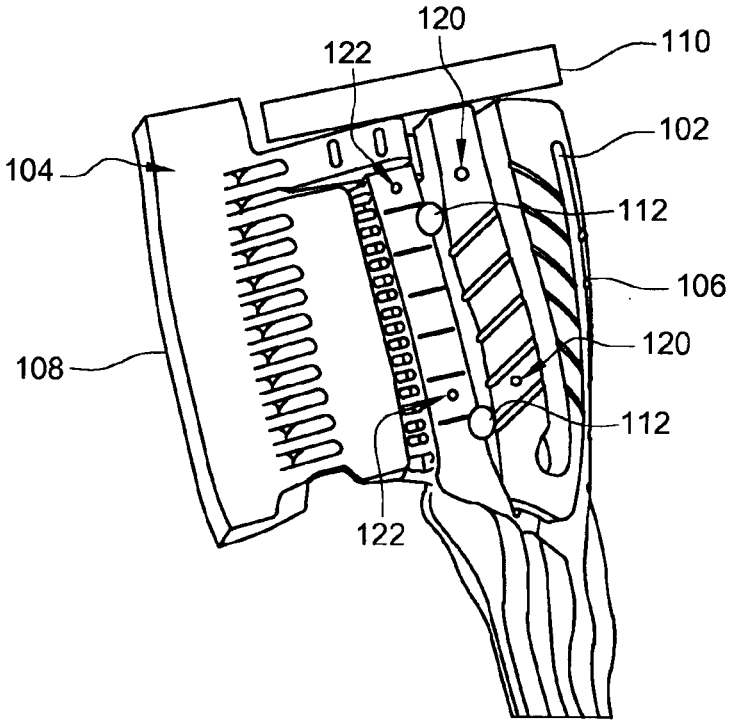
FIG. 3 shows a first step of assembling the core elements of FIGS. 2*a* and 2*b;*
Figure 4:
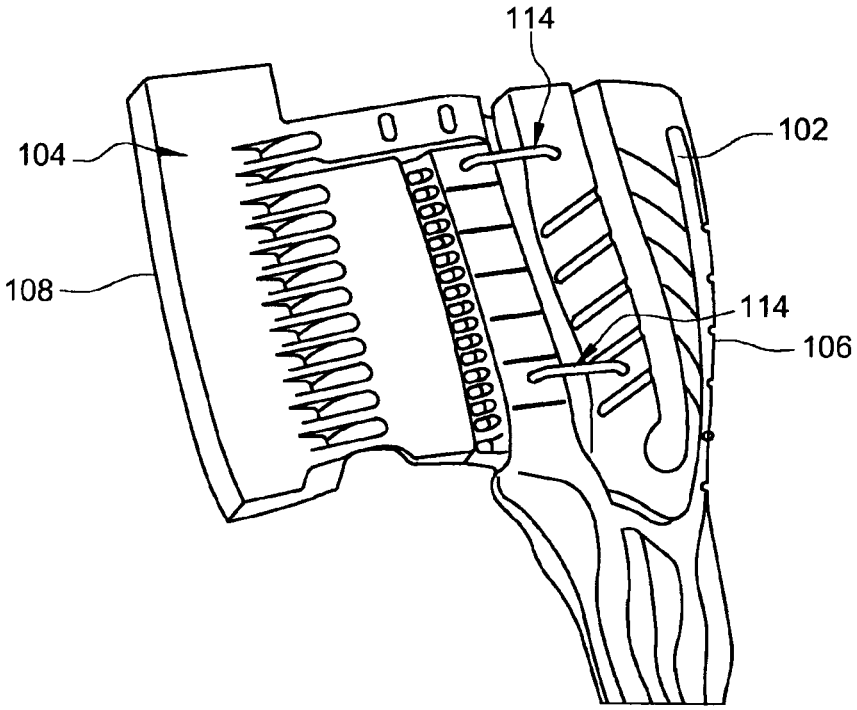
FIG. 4 shows a second step of assembling the core elements of FIGS. 2*a* and 2*b;*
Figure 5:
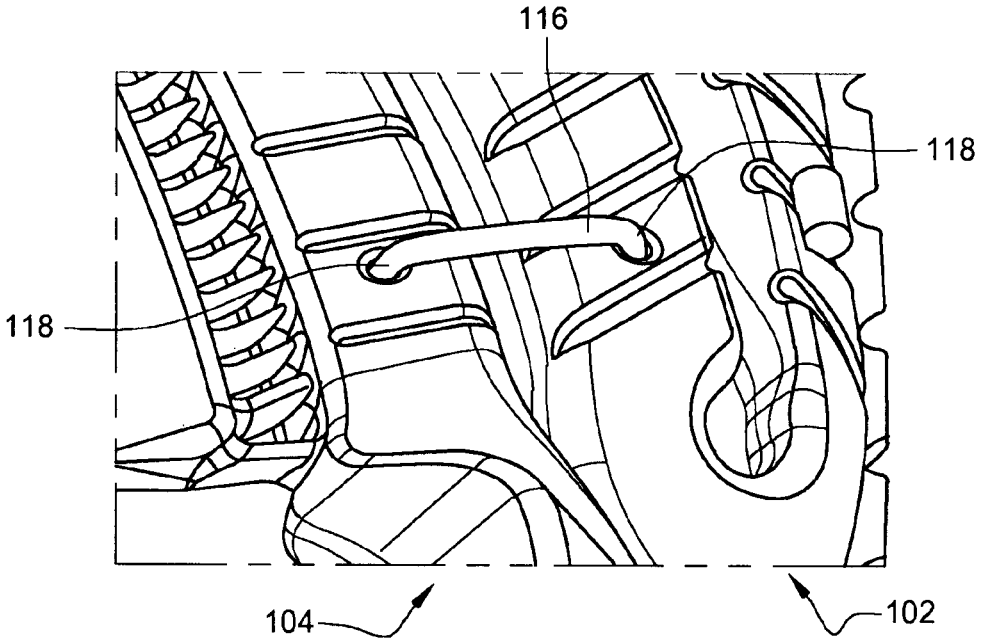
FIG. 5 shows a schematic perspective view of a staple connecting the core elements of FIGS. 2*a* and 2*b;*

FIGS. 3 and 4 show steps of assembling the core elements 102 and 104 before positioning them in the wax mold 10.

First, the core elements 102 and 104 are positioned with respect to each other using an axial or longitudinal stop 110 and two first spacers 112. The stop 110 allows aligning the core elements 102 and 104 in an axial or longitudinal direction. The first spacers 112 allow keeping a distance between the core 102 and the core 104 in a direction perpendicular to the longitudinal direction. This distance between the core elements 102 and 104 allows forming a wall between two cavities in the vane, after making the wax model and casting a molten metallic material into a shell mold made from the wax model.

It is essential to prevent the core elements from moving relative to one another during the injection of wax into the wax mold or during casting of the molten metallic material into the shell mold, so that the manufactured vane meets the dimensional specifications.

For this purpose, one or more staple(s) 114 is/are configured to hold the core elements 102 and 104 relative to each other. Each staple 114 comprises a central portion 116, two branches 118 extending perpendicular to the central portion 116, from each of the ends of the central portion 116. The branches 118 of the staples 114 are fitted into the orifices 120 of the core 102 and into the orifices 122 of the core 104.

The staple 114 may be held in the orifices 120 and 122 by a bonding step, for example by means of a suitable glue or wax.

The staple is made of platinum or of any other material adapted to be melted during casting of the metallic material.

Once the core elements 102 and 104 are held together using the staples, the spacers 112 are removed and the core elements 102 and 104 are positioned in the wax mold 10.

In another embodiment, the core members 102 and 104 are positioned with respect to each other without the use of spacers 112. In this case, the core elements 102 and 104 held together are arranged directly in the wax mold 10.

The orifices 120 or 122 may be blind orifices.

Figure 6:
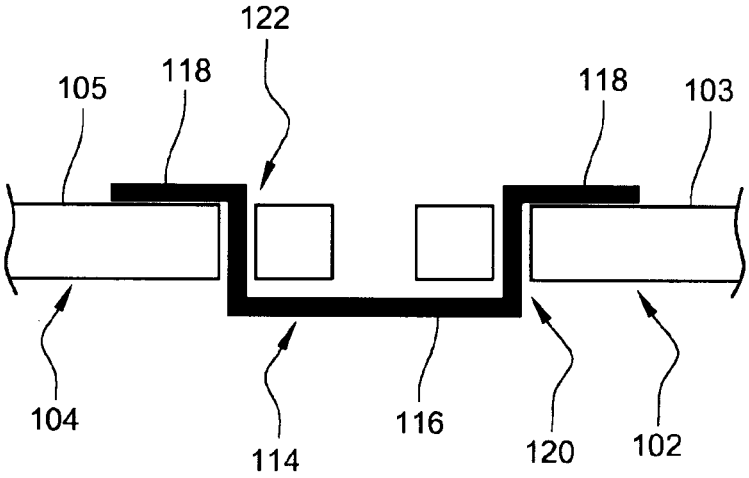
FIG. 6 shows a schematic sectional view of a staple connecting the core elements of FIGS. 2*a* and 2*b*.

The orifices 120 or 122 may consist of open-through orifices as shown in FIG. 6. In this case, the ends of the branches 118 may be folded over a surface 103 of the core 102, respectively a surface 105 of the core 104, opposite to the central portion 116. In this manner, bonding the staple 114 is no longer necessary to hold the staple 114 in position.

Figure 7:
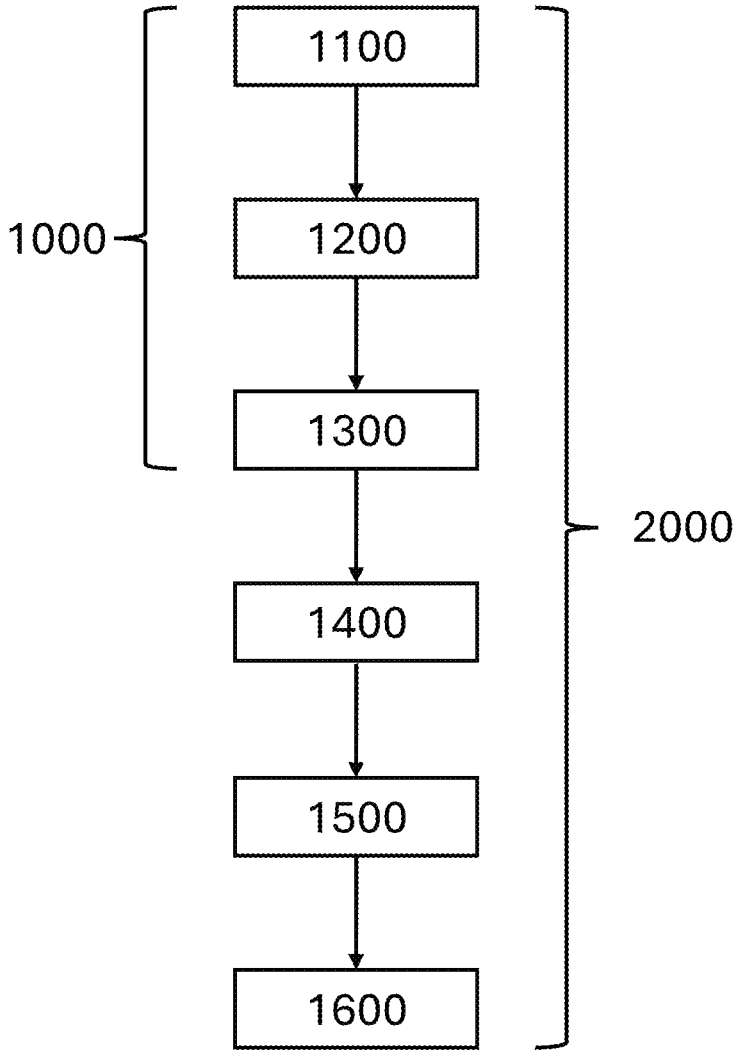
FIG. 7 shows a block diagram of a method for making a wax model for manufacturing a part.

FIG. 7 shows a method 1000 for making a wax model for manufacturing a part, the part comprising a cavity, the method 1000 comprising the steps of: arranging 1100 at least two core elements made of a ceramic material in a wax mold, the at least two core elements having, at least partially, a shape complementary to the cavity of the part to be manufactured; assembling 1200 the at least two core elements together by a staple, wherein the staple includes a central portion from which two branches extend, each branch of the two branches being fitted into a respective orifice formed in a respective one of the at least two core elements, and wherein the orifice of at least one of the at least two core elements is an open-through orifice, the branch of the two branches of the staple passing through the open-through orifice having a free end folded over the core element that has the open-through orifice so as to maintain the staple in position; and injecting 1300 wax into the wax mold, around the assembled core elements, so as to form the wax model.

FIG. 7 also shows a method 2000 for manufacturing a part having at least one cavity, the method comprising the steps of: making 1000 a wax model by: arranging 1100 at least two core elements made of a ceramic material in a wax mold, said at least two core elements having, at least partially, a shape complementary to the at least one cavity of the part to be manufactured; assembling 1200 the at least two core elements together by a staple, wherein the staple includes a central portion from which two branches extend, each branch of the two branches being fitted into a respective orifice formed in a respective one of the at least two core elements, and wherein the orifice of at least one of the at least two core elements is an open-through orifice, the branch of the two branches of the staple passing through said open-through orifice having a free end folded over the core element that has the open-through orifice so as to maintain the staple in position; and injecting 1300 wax into the wax mold, around the assembled core elements, so as to form the wax model.

The method 2000 shown in FIG. 7 also comprises the following steps: forming 1400 a shell mold made of a ceramic material from the wax model; eliminating 1500 the wax model; and casting 1600 a molten metallic material into the shell mold.

The invention claimed is:

1. A method for making a wax model for manufacturing a part, said part comprising a cavity, the method comprising the steps of:

arranging at least two core elements made of a ceramic material in a wax mold, said at least two core elements having, at least partially, a shape complementary to the cavity of the part to be manufactured;

assembling the at least two core elements together by a staple, thereby obtaining assembled core elements, wherein the staple includes a central portion from which two branches extend, each branch of the two branches being fitted into a respective orifice formed in a respective one of the at least two core elements, and wherein the orifice of at least one of the at least two core elements is an open-through orifice, the branch of the two branches of the staple passing through said open-through orifice having a free end folded over the core element that has the open-through orifice so as to maintain the staple in position; and injecting wax into the wax mold, around the assembled core elements, so as to form the wax model.

2. The method according to claim 1, wherein at least one of the two branches of the staple is held in the respective orifice by glue.

3. The method according to claim 1, wherein the central portion and the two branches of the staple have a circular cross-section.

4. The method according to claim 1, wherein the at least two core elements have a respective first lateral surface, both first lateral surfaces facing a same side, and wherein the staple is placed so that the central branch is against said first lateral surfaces of the at least two core elements.

5. The method according to claim 4, wherein the two branches have respective distal portions that are folded over second lateral surfaces of the at least two core elements opposite to the first lateral surfaces, the two branches of the staple being folded over said second lateral surfaces along two opposite directions.

6. The method according to claim 1, wherein the part is a turbine vane.

7. A method for manufacturing a part having at least one cavity, the method comprising the steps of:

making a wax model by:

arranging at least two core elements made of a ceramic material in a wax mold, said at least two core elements having, at least partially, a shape complementary to the at least one cavity of the part to be manufactured;

assembling the at least two core elements together by a staple, thereby obtaining assembled core elements, wherein the staple includes a central portion from which two branches extend, each branch of the two branches being fitted into a respective orifice formed in a respective one of the at least two core elements, and wherein the orifice of at least one of the at least two core elements is an open-through orifice, the branch of the two branches of the staple passing through said open-through orifice having a free end folded over the core element that has the open-through orifice so as to maintain the staple in position; and injecting wax into the wax mold, around the assembled core elements, so as to form the wax model, forming a shell mold made of a ceramic material from the wax model;

eliminating the wax model; and casting a molten metallic material into the shell mold.

8. The method according to claim 7, wherein the part is a vane of a rotating turbine.

9. The method according to claim 7, wherein the part is a turbine stator vane.

* * * * *